US005361846A

United States Patent [19]

Carlin et al.

[11] Patent Number: 5,361,846

[45] Date of Patent: Nov. 8, 1994

[54] APPARATUS AND METHOD FOR ENHANCING FATIGUE PROPERTIES OF SUBTERRANEAN WELL DRILL PIPE IMMEDIATE THE AREA OF SECUREMENT TO A TOOL JOINT

[75] Inventors: Frank J. Carlin, Houston; John F. Price, Navasota, both of Tex.

[73] Assignee: Grant TFW, Inc.

[21] Appl. No.: 155,011

[22] Filed: Nov. 19, 1993

[51] Int. Cl.[5] ..... E21B 17/00

[52] U.S. Cl. ..... 166/380; 138/177; 166/242; 175/320; 285/176

[58] Field of Search ..... 175/320; 166/242, 380; 138/155, 177; 285/176, 177, 333

[56] References Cited

U.S. PATENT DOCUMENTS

| | | | |
|---|---|---|---|
| 1,325,073 | 12/1919 | Boyd et al. | 285/333 X |
| 3,152,458 | 10/1964 | Simonin | 175/320 X |
| 4,002,359 | 1/1977 | Lari | 285/333 X |
| 4,616,476 | 11/1983 | Garrett | 285/333 X |
| 4,629,218 | 12/1986 | Dubois | 285/176 |
| 4,760,889 | 8/1988 | Dudman | 175/320 |
| 5,286,069 | 2/1994 | Wilson | 285/333 X |

FOREIGN PATENT DOCUMENTS

| | | | |
|---|---|---|---|
| 353180 | 1/1990 | European Pat. Off. | 175/320 |
| 204726 | 12/1983 | Germany | 175/320 |

*Primary Examiner*—Hoang C. Dang

*Attorney, Agent, or Firm*—Jackson & Walker

[57] ABSTRACT

An apparatus and method are provided for enhancing fatigue properties of subterranean well drill pipe immediate the area of securement to a tool joint by providing a multi-ramp upset series on the drill pipe which, in effect, enhances fatigue resistance properties of the pipe by increasing the wall thickness on the end of the drill pipe conduit to a greater length than that found on prior art, conventional upsets adjacent the drill pipe. The increased length of this upset configuration provides a smoother transition from the thick upset adjacent the tool joint down to the thin drill pipe body.

4 Claims, 1 Drawing Sheet

Figure 1:
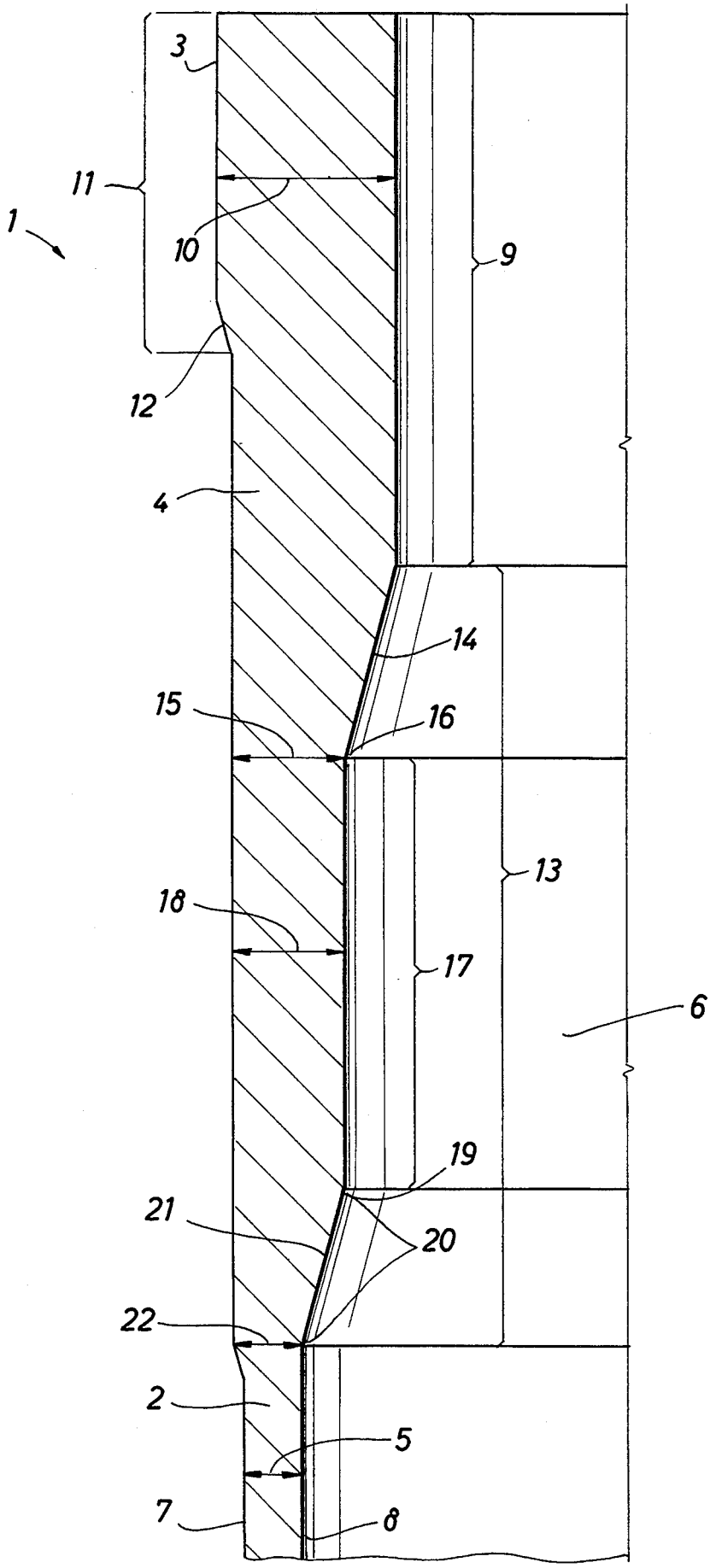

APPARATUS AND METHOD FOR ENHANCING FATIGUE PROPERTIES OF SUBTERRANEAN WELL DRILL PIPE IMMEDIATE THE AREA OF SECUREMENT TO A TOOL JOINT

BACKGROUND OF THE INVENTION

1. Field of the Invention

The invention relates to drill pipe for subterranean wells, and the like, having upset areas adjacent the area of securement thereof to a tool joint.

2. Brief Description of the Prior Art

When drill pipe is used to drill subterranean wells, the pipe is exposed to bending stresses. Such bending stresses are primarily due to hole curvatures extending through the entire length of the drilled hole. Such stresses may cause fatigue of the drill pipe due to fluctuating reversed bending stress which is imposed during rotation of the drill pipe. If the drill pipe fails by such resulting fatigue, the location of the fatigue point is oftentimes approximate the area of securement at the lowermost end thereof, i.e., from about 1 to about 5 feet from the point of securement of the end of the pipe to the tool joint. The stress in this portion of the drill pipe is usually considerably higher than the stress which is imposed on the remaining portions of the drill pipe conduit.

Applicant is aware of the following prior art which is addressed to similar problems of stress on subterranean well conduits, but which does not anticipate or render obvious the present invention: (1) U.S. Pat. No. 4,416,476, issued Nov. 22, 1983, and entitled "Intermediate Weight Drill Stem Member"; and (2) U.S. Pat. No. 1,325,073, issued Dec. 16, 1919, and entitled "Method Of Forming Coupling Ends On Drill Tube Sections".

The present invention addresses some of the deficiencies as described in the prior art.

BRIEF DESCRIPTION OF THE SOLE FIGURE

The sole figure, FIG. 1, is a quarter cross sectional elevated view of a conduit member incorporating the dual ramp upset configuration of the present invention.

SUMMARY OF THE INVENTION

Now, with reference to FIG. 1, there is shown thereon an apparatus 1, which, as shown, consists of a lower portion of a drill pipe 2 having at its upper end an area of securement 3 for a tool joint (not shown). The tool joint, per se, is not a part of the present invention, and may be secured at area 3 by one of a number of conventional means, typically by welding. As shown, the drill pipe 2 may consist of a number of sections or members, to make up a total drill string extending from the top of the well to the lowermost portion thereof during drilling. Drill pipe conduit member 4 is representative of such sections.

As shown in the Fig., immediate the lowermost portion thereof, the drill pipe conduit member 4 has a normal conduit wall thickness 5, with the drill pipe conduit member 4 having a fluid passageway 6 disposed therethrough for communication of fluids, such as drilling mud, and the like, during the drilling procedure. The drill pipe conduit member 4 also has a first outer diameter surface 7 and a first inner diameter surface 8. Those surfaces, in total, define a normal conduit wall thickness 5 thereacross.

The apparatus 1 has a first tapered length 9 extending from area 3 of securement of a tool joint to the uppermost end of a second tapered surface 14, more fully described below. As a part of the first tapered length 9, a first ramp upset section 11 is provided which extends from the area 3 of securement of a tool joint to the lowermost end of a tapered surface 12, which is defined, as shown, around the outer diameter of the drill pipe conduit member 4. As shown in the drawing, the first tapered length 9 has a "largest" wall thickness 10 therethrough which extends from the area 3 to the uppermost end, or point, at the beginning of the tapered surface 12.

Of course, in forming the tapered surface 12 of the first tapered length 9, one may provide such surface 12 on either the outer diameter and/or the inner diameter of the drill pipe conduit member 4. As shown, the tapered surface 12 is defined on the outer diameter of the conduit member 4 within the first tapered length 9 to thus provide the "largest" wall thickness 10 therethrough.

As stated above, the invention incorporates a provision of a first tapered length 9 as well as a second tapered length 13 therebelow on the drill pipe conduit member 4. The second tapered length 13 extends from the uppermost end of the second tapered surface 14 which, as shown, is defined on the inner diameter of the drill pipe member 14, and extends to the minimum wall thickness 22 of the second ramp upset section 20.

It will be appreciated by those skilled in the art that the second tapered surface 14 may be as easily profiled on the outer diameter of the drill pipe conduit member 4 within the second tapered length 13. Alternatively, such second tapered surface 14 may also be profiled on the drill pipe conduit member 4 by tapering both the inner and outer diameters of the conduit member 4 thereacross.

The second tapered length 13 also includes an elongated continuously smooth transition surface 17 which has a first end 16 at the lowermost tip end of the second tapered surface 14 which, at such point, defines through the conduit member 4 the "smallest" wall thickness of the second tapered length 13 through the diameter 15 thereacross. The transition surface 17 is extremely important to the present invention because it provides a considerably long length of continuous wall thickness 18 thereacross which results in lower bending stresses. The resultant lower stress is due to a shortening of the effective bending moment at the point of the beginning of minimum or nominal wall thickness 22 through a second ramp upset section 20 of the second tapered length 13.

By providing the two ramp upset concept of the present invention with a long transition surface 17 extending between the second tapered surface 14 and the second ramp upset section 20, an additional length is provided for the absorption of such fatigue which is caused by bending stress fluctuation. In other words, such fluctuation is broken or abated considerably by means of an absorption or a transition surface 17 which is provided between each of the tapered surfaces 14 and 20 in the second tapered length 13.

As stated above, the transition surface 17 terminates at its lower end 19 which, in turn, defines the uppermost point, or end, of a second ramp upset section 20, which defines a third tapered surface 21 on the internal diameter of the drill pipe conduit member 4. Again, as with other tapered surfaces 14 and 12, the third tapered surface 21, is shown as defined on the inner diameter of the drill pipe conduit member 4, but may be equally defined around the outer diameter of same, or, alternatively, may be defined by having the third tapered surface 21 being defined on both the inner and outer diameter of the drill pipe conduit member 4.

The second ramp upset section 20 has its minimum wall thickness 22 defined thereacross which, as shown, is substantially equal to normal conduit thickness 5 of the drill pipe portion The first and second tapered lengths 9 and 13, can be made during a conventional upsetting procedure well known to those skilled in the art by gathering a maximum amount of material during a first pass of the upset operation to thereby provide a transition zone. By gathering the maximum amount of such material in the first pass, the transition zone will increase the effective length of the upset by at least a fact of 2. The resultant lower stress provided by incorporating the transition surface 17 between the second ramp upset section 20 and the second tapered surface 14 in effect lowers stress because of a shortening of the effective bending moment at the point of the beginning of minimum wall thickness 22 on the tubing.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for enhancing fatigue properties of subterranean well drill pipe immediate the area of securement to a tool joint, comprising:

(a) a drill pipe conduit member having a normal conduit wall thickness thereacross and a fluid passageway extending therethrough;

(b) first outer diameter and first inner diameter surfaces defined through the normal conduit wall thickness on said conduit member;

(c) a first tapered length extending to the area of securement to a tool joint and providing a largest wall thickness thereacross in excess of the normal conduit wall thickness to thereby provide a first ramp upset section and defined by one or more tapered surfaces on the outer diameter surface defined on the conduit member through the first ramp upset section;

(d) a second tapered length immediately adjacent to said first tapered length and including: (1) at least one second tapered surface defined on said inner diameter of said conduit member, said second tapered surface having a smallest wall thickness therethrough less than that of the largest wall thickness of the first tapered length and extending to a first end of; (ii) an elongate transition surface having a continuous conduit wall thickness thereacross equal to that of the smallest wall thickness of the second tapered surface, said transition surface having a second opposing end extending to; (iii) a second ramp upset section adjoining the second opposing end of the transition surface and defined by one or more third tapered surfaces on the inner diameter of the conduit member to thereby provide a minimum wall thickness through the second ramp upset section on the conduit which is less than the wall thickness across the transition surface, and equal to the normal conduit wall thickness of the drill pipe conduit member.

2. The apparatus of claim 1 wherein the second tapered length is no more than about the length of the first tapered length.

3. A method for enhancing fatigue properties of drill pipe immediate the area of securement to a tool joint, comprising the steps of:

(a) providing a drill pipe conduit member having a normal conduit wall thickness thereacross and a fluid passageway extending therethrough;

(b) defining first outer diameter and first inner diameter surfaces through the normal conduit wall thickness on said conduit member;

(c) upsetting the drill pipe conduit member to provide a first tapered length extending to the area of securement to a tool joint and providing a largest wall thickness thereacross in excess of the normal conduit wall thickness to thereby provide a first ramp upset section defined by one or more tapered surfaces on the outer diameter surface defined on the conduit member through the first ramp upset section; and providing a second tapered length immediately adjacent to said first tapered length, and further providing: (i) at least one second tapered surface on said inner diameter of said conduit member, said second tapered surface thereby defining a smallest wall thickness therethrough less than that of the largest wall thickness of the first tapered length and extending same to a first end of; (ii) an elongate transition surface defined on said drill pipe conduit member, and defining on said surface a continuous conduit wall thickness thereacross equal to that of the smallest wall thickness of the second tapered surface, said transition surface having a second opposing end to; (iii) a second ramp upset section adjoiningly defined on the second opposing end of the transition surface, and providing one or more third tapered surfaces on said inner diameter of the conduit member whereby there is provided a minimum wall thickness through the second ramp upset section on the conduit which is less than the wall thickness of the drill pipe conduit member.

4. The method of claim 3, wherein the second tapered length is extended no more than about the length of the first tapered length.

* * * * *